US006086450A

United States Patent [19]

Mankovitz

[11] Patent Number: 6,086,450

[45] Date of Patent: Jul. 11, 2000

[54] BRASSIERES WHICH FACILITATE THE DRAINAGE OF LYMPHATIC FLUID FROM THE BREAST AREA OF THE HUMAN FEMALE

[76] Inventor: Roy J. Mankovitz, 24236 Park Granada, Calabasas, Calif. 91302

[21] Appl. No.: 09/290,020

[22] Filed: Apr. 9, 1999

Related U.S. Application Data

[60] Provisional application No. 60/096,418, Aug. 13, 1998.

[51] Int. Cl.[7] ..... A41C 12/00

[52] U.S. Cl. ..... 450/20; 450/1; 450/44

[58] Field of Search ..... 450/1, 65–68, 450/70–72, 74–76, 19–21, 38–40, 44, 57–58; 2/69; 601/1, 14, 151; 602/19, 41, 60, 61, 63

[56] References Cited

U.S. PATENT DOCUMENTS

| | | | |
|---|---|---|---|
| 2,824,563 | 2/1958 | Hill | 450/44 |
| 2,864,372 | 12/1958 | Buckley | 450/44 |
| 3,254,653 | 6/1966 | Krieger | 450/1 |
| 4,955,909 | 9/1990 | Ersek et al. | 623/7 |
| 5,429,593 | 7/1995 | Matory | 602/19 |
| 5,522,892 | 6/1996 | Lin | 450/57 X |
| 5,538,502 | 7/1996 | Johnstone | 602/19 |
| 5,782,671 | 7/1998 | Suen et al. | 450/38 |
| 5,800,245 | 9/1998 | Barbe-Vicuna et al. . | |

*Primary Examiner*—Gloria Hale
*Attorney, Agent, or Firm*—Gifford, Krass, Groh, Sprinkle, Anderson & Citkowski, PC

[57] ABSTRACT

Bosom-support garments such as brassieres reduce lymph flow interference by providing a pattern of alternating higher and lower skin-compression areas which are configured to follow the direction of the lymph pathways in the various sectors of the breast, side, and/or back areas of the wearer. Preferably the areas of lower skin compression do not actually touch the skin, and the width of and spacing of the pattern may be varied at different areas of the garment to accommodate the comfort of the wearer and to optimize the flow of lymph. The pattern may be defined by elongated ribs of relatively higher density material formed through weaving, compression molding, or other appropriate processes. Such ribs preferably extend generally away from the nipple area of the breast so that the pattern corresponds to lymph drainage pathways leading to the axillary or subclavicular nodes, to an intercostal space, or to a plurality or all of the above. The pattern may be defined by pockets or cells at least partially filled with a solid, a liquid, or a gas. As an alternative to elongated ribs, the pattern may be defined by localized, semi-rigid regions operative to massage the lymph drainage pathways when the garment is worn. As one example of many, such regions may be in the form of semi-rigid members disposed at an angle relative to the skin and terminating in skin-contacting points, causing the application of a generally upward force when the garment is worn. In particular, upward arm and shoulder motion as a result of normal body movement during the day causes the shoulder straps to periodically pull up on the outer wall of the fabric, which causes the semi-rigid members or "fingers" to press against and slide upward along the inner wall, thereby exerting a generally upward force on the wearer's skin. This force gently massages the lymph ducts, helping to push the lymph fluid in a desired upward direction.

26 Claims, 5 Drawing Sheets

BRASSIERES WHICH FACILITATE THE DRAINAGE OF LYMPHATIC FLUID FROM THE BREAST AREA OF THE HUMAN FEMALE

REFERENCE TO RELATED APPLICATION

This application claims priority of U.S. provisional application Ser. No. 60/096,418, filed Aug. 13, 1998, the entire contents of which are incorporated herein by reference.

FIELD OF THE INVENTION

This invention relates generally to female bosom support garments and, in particular, to brassieres which allow or promote the drainage of lymphatic fluid from the breast area of a human female.

BACKGROUND OF THE INVENTION

Breast cancer has become a major health problem among the adult female population in the Western world. It is interesting to look at anthropological studies in an attempt to ascertain causes of this problem which may be related to our modern-day lifestyle.

Medical anthropologist Sidney Ross Singer hypothesized that a link may exist between breast cancer and brassieres. He conducted a study to examine the history, attitudes, and behaviors of women with and without breast cancer in five major cities across the U.S. From 1991 to 1993, Singer and Soma Grismaijer interviewed over 4700 women and found a significant correlation between the breast cancer risk factor and the number of hours per day women wore brassieres. The results of the study are presented in the book "Dressed to Kill," by Sidney Ross Singer and Soma Grismaijer, Avery Publishing Group, 1995.

In FIG. 1 there is shown a conventional brassiere, comprising a support band which encircles the torso under the breasts, and which is usually fastened in the back. Two cups are attached to the band, and shoulder straps connect between the top of each cup and the rear portion of the support bandIt has been hypothesized that conventional garments of this type constrict blood circulation and impede lymphatic flow. The largest mass of lymph nodes in the upper body is located in an area extending up from the breast to just under the arm. These nodes drain lymph from the breast area into the thoracic duct, which flows to the heart. By suppressing the flow of lymph, brassieres may cause toxins to accumulate in the tissues of the breasts which, in turn, might be responsible for creating an environment conclusive to the formation of breast cancer.

U.S. Pat. No. 5,800,245 discloses a compression brassiere and pad for manual lymph drainage. The objective appears to be to minimize the accumulation of lymph in the breast area between weekly sessions of lymph massage be applying continuous compression to various portions the breast area. The inventor of the present invention believes that the application of continuous compression in these areas is in fact highly undesirable, since such compression is more likely to contribute to the constriction of lymph flow.

It is a hypothesis of the present invention that the conventional designs of brassieres do indeed impede the drainage of lymph fluid from the breast area, and that such impeded flow may increase the risk of developing breast cancer. It is therefore an object of the present invention to provide brassieres which support the wearer's breasts, but are also designed to aid the drainage of lymph fluid from the breast and surrounding tissue.

SUMMARY OF THE INVENTION

The subject invention resides in bosom-support garments designed to reduce interference with lymph flow as compared to prior-art designs, which act to provide large areas of breast compression which cross over and clamp down on lymph pathways, thereby restricting flow. Although the detailed description is directed toward a traditional brassiere having relatively narrow straps and a rear closure, the invention is applicable to any breast-covering or supporting garments such as bustiers, corsets, swim apparel, and so forth, regardless of the closure configuration.

A preferred embodiment of the invention provides a bosom-supporting garment having a body-facing surface with a pattern of alternating higher and lower skin-compression areas which are configured to follow the direction of the lymph pathways in the various sectors of the breast and back areas of the wearer. Preferably the construction of the garment is such that the lower skin-compression areas do not actually touch the skin, though this is not a requirement so long as the general goal of lymph pathway reduced constriction is met. In addition, the width of and spacing of the pattern may be varied at different areas of the garment to accommodate the comfort of the wearer and to optimize the flow of lymph. In general, it is desirable to maximize the width of the pathways to provide as much unrestricted area as possible for lymph flow while maintaining sufficient bosom support.

According to one implementation of the invention the lymph pathway conformal pattern may be defined by elongated ribs of relatively higher density material formed through weaving, compression molding, or other appropriate processes. Such ribs preferably extend generally away from the nipple area of the breast. In particular, considering that the breast may be divided into upper, lower, outer and medial quadrants, the pattern may correspond to lymph drainage pathways leading to an axillary node associated with the upper and lower outer quadrants, or to lymph drainage pathways leading to an subclavicular node associated with the upper medial quadrant, to lymph drainage pathways leading to an intercostal space associated with the lower medial quadrant, or to a plurality or all of the above. The pattern may be defined by pockets or cells at least partially filled with a solid, a liquid, or a gas, and may extend to side and back panels in addition to breast-covering portions.

As an alternative to elongated ribs, the pattern may be defined by localized, semi-rigid regions operative to massage the lymph drainage pathways when the garment is worn. As one example of many, such regions may be in the form of semi-rigid members disposed at an angle relative to the skin and terminating in skin-contacting points, causing the application of a generally upward force when the garment is worn. In particular, upward arm and shoulder motion as a result of normal body movement during the day causes the shoulder straps to periodically pull up on the outer wall of the fabric, which causes the semi-rigid members or "fingers" to press against and slide upward along the inner wall, thereby exerting a generally upward force on the wearer's skin. This force gently massages the lymph ducts, helping to push the lymph fluid in a desired upward direction.

DESCRIPTION OF THE INVENTION

Figure 2:
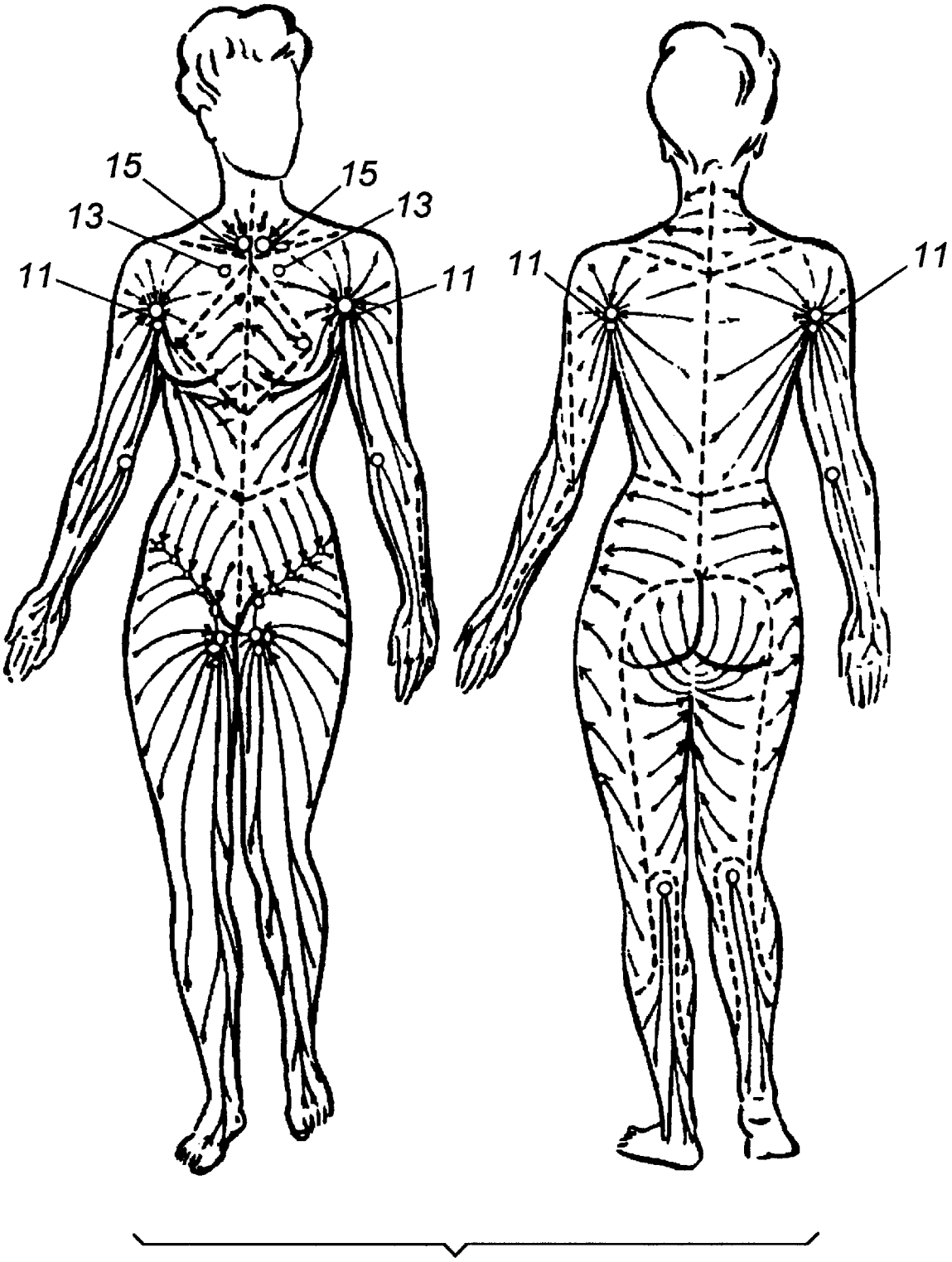
FIG. 2 is a schematic representation of the lymph drainage pathways in a human female.

Referring to FIG. 2, there is shown a schematic representation of the lymph drainage pathways in a human female. Of particular interest are the collecting lymph nodes in the upper portion of the body: the axillary nodes 11 under the armpits, the subclavicular nodes 13, and the terminus 15. These nodes and the lymph flow patterns in the breast area are more clearly shown in FIG. 3, which is a diagram of the lymph drainage from the head, neck and breast area. If the breast is divided into four quadrants as shown by the lines radiating from the nipple 17 in the figure, then it can be seen that the lymph from the upper and lower outer lateral quadrants drains to the axillary nodes 11. The lymph from the medial upper quadrant drains to the subclavicular nodes 13, and then to the terminus 15. Lymph from the lower medial quadrant flows pasternally into the intercostal space and on the inner thorax wall along the costal arch to the spinal column and then into the thoracic duct. In general in the breast area, the direction of lymph fluid drainage is upward. The lymph fluid moves in response to torso movement and muscle contraction, and the lymph system contains several check valves to prevent backflow.

Figure 1:
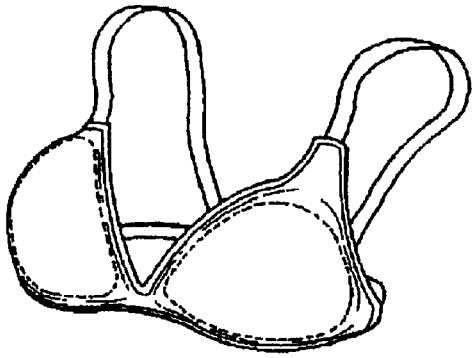
Fig - 1 (PRIOR ART)
FIG. 1 is a n oblique representation of a conventional brassiere, comprising a support band which encircles the torso under the breasts, generally fastened in the back.
Figure 4:
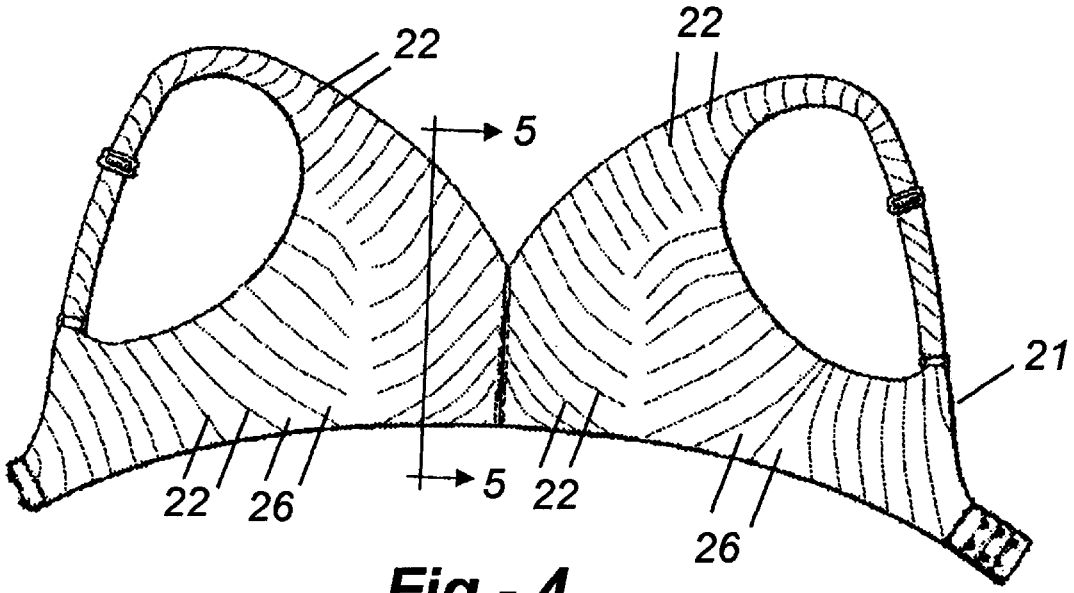
FIG. 4 is a front plan view of the brassiere according to a first preferred embodiment of the invention, which opened up to show all sections.

A first preferred embodiment of a brassiere 20 constructed in accordance with the present invention is shown in FIG. 4, which is a front plan view of the brassiere opened up to show all sections. The intention of this design is to decrease the restriction of lymph flow from that caused by wearing a brassiere of conventional design such as shown in FIG. 1. In this embodiment, the conventional brassiere shape is substantially maintained, but the material comprising the brassiere comprises a base material 21 to which are attached a plethora of spaced apart ribs 22. The lines 22 shown in FIG. 4 represent the ribs, the construction of which is more clearly shown in FIG. 5, which is a cross-sectional view of the brassiere of FIG. 4, taken along the line 5—5.

Figure 5:
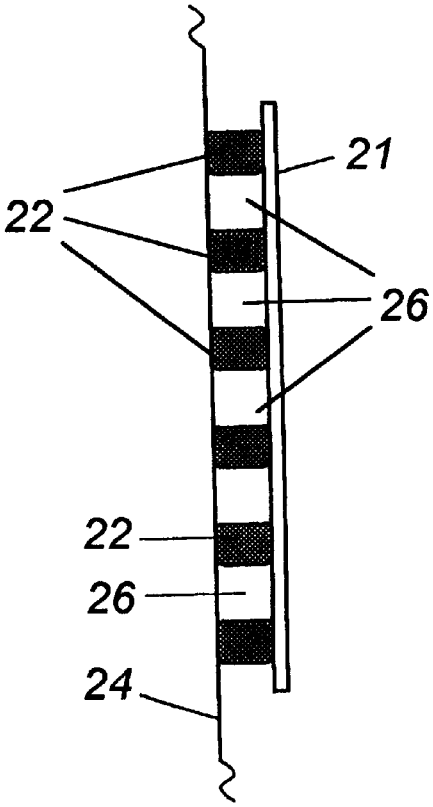
FIG. 5 is a cross-sectional view of spaced-apart ribs designed to contact the surface of the skin of the wearer while leaving spaces or pathways between the ribs where no material is in contact with the skin.
Figure 6:
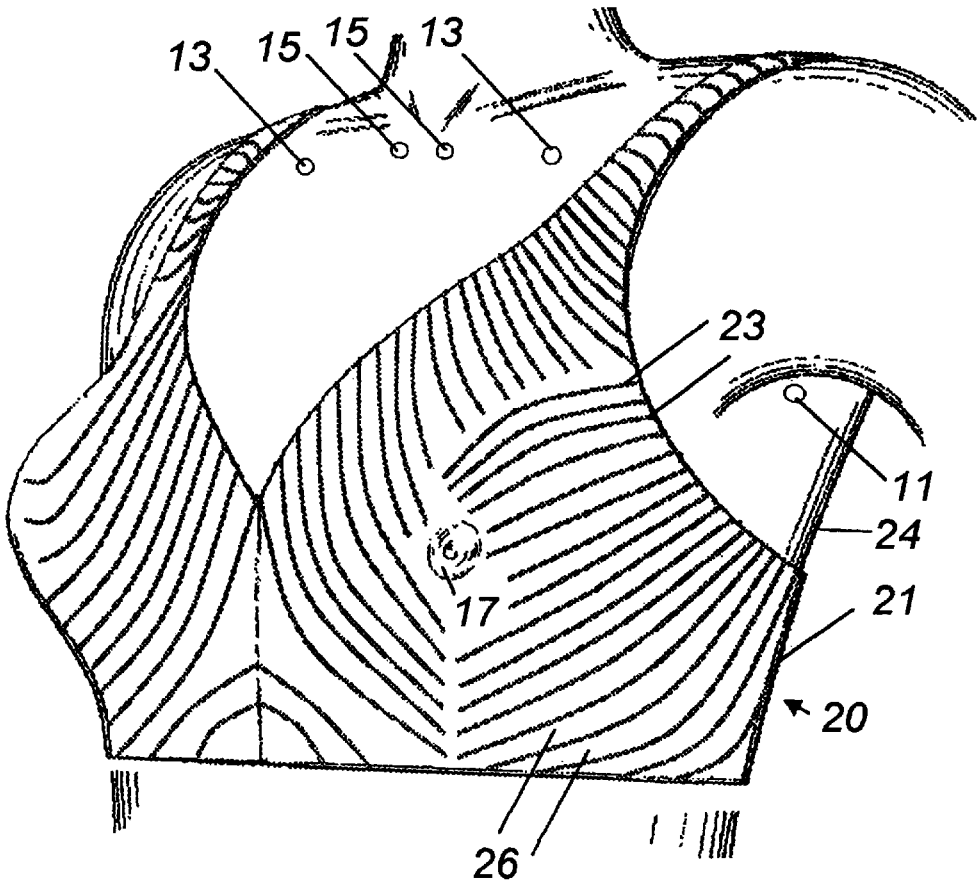
FIG. 6 illustrates brassiere according to the invention in place on a wearer, where it may be seen that ribs in combination with intercellular spaces provide pathways shaped to follow or conform to a woman's lymph drainage pathways.

Referring to FIG. 5, the ribs 22 are spaced apart along the base material 21, and are designed to contact the surface of the skin 24 of the wearer, while leaving spaces or pathways 26 between the ribs where no material is in contact with the skin. As will become more apparent from the following discussion, the spaces 26 are designed to provide areas where no constriction of or pressure on the lymph ducts occurs, so that unimpeded drainage of lymph fluid may take place. The ribs 22 may be formed by weaving or pressure-formation as part of the base material 21 resulting in a pattern similar to corduroy. Alternatively, the ribs 22 may be formed as pockets or cells filled with a solid such as foam, or a liquid or a gas having sufficient internal pressure to maintain the pathways 26 when the brassiere 20 is worm. Referring now to FIG. 6, which shows the brassiere 20 in place on a wearer, it may be seen that the ribs 22 in combination with the intercellular spaces 26 act to provide pathways 26 which are shaped to follow or conform to the lymph drainage pathways shown in FIG. 2 and described above. Thus, the ribs 22 in the upper and lower outer lateral quadrants around the area of the nipple 17 are shaped to provide drainage pathways 26 toward the axillary nodes 11. The ribs 22 in the area of the medial upper quadrant are shaped to provide drainage pathways 26 toward the subclavicular nodes 13, and then to the terminus 15. The ribs 22 in the area of the lower medial quadrant are shaped to provide drainage pathways 26 toward the intercostal space.

Figure 7:
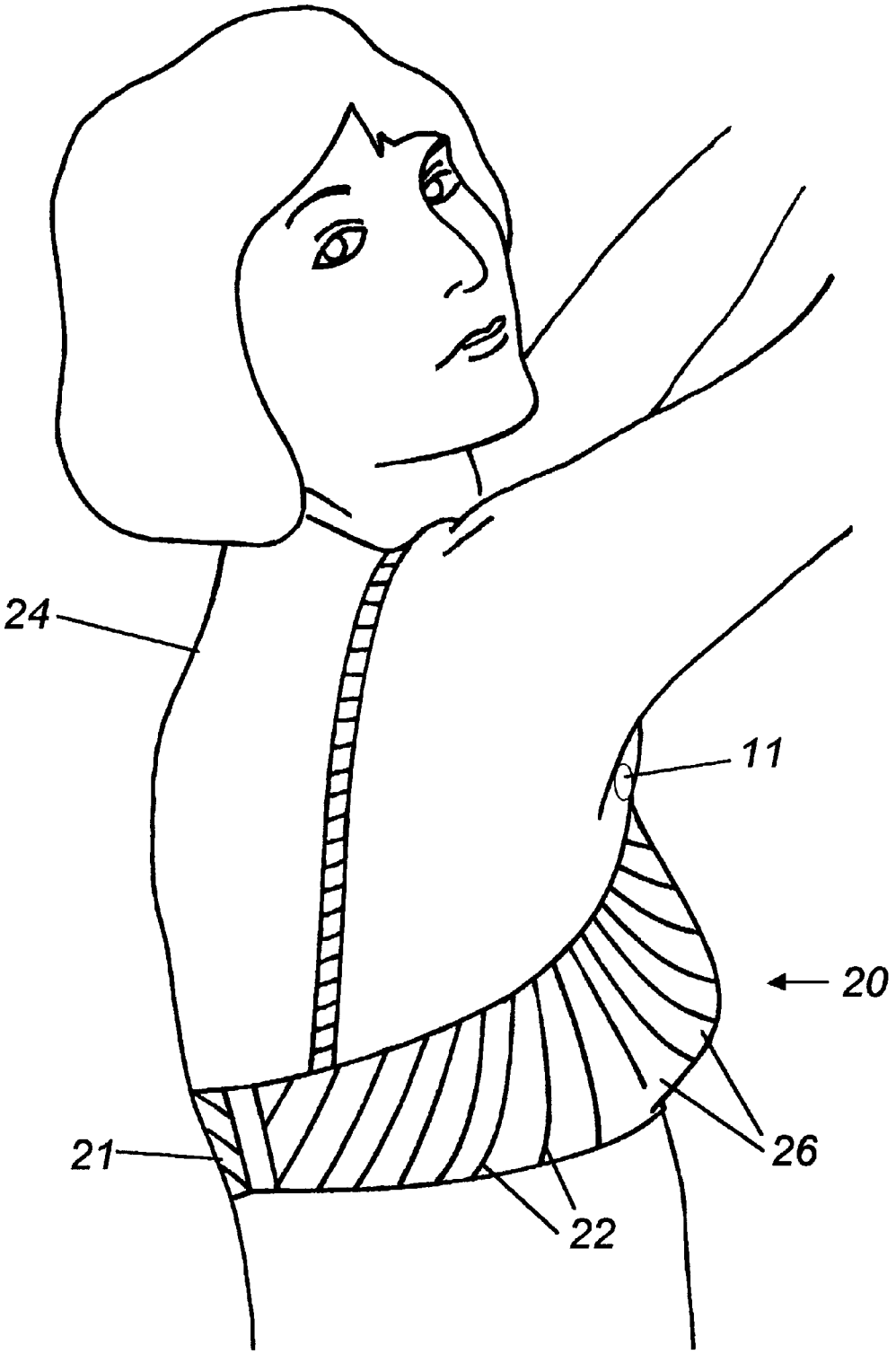
FIG. 7 provides rear and side views of the brassiere of FIG. 6.

FIG. 7 is a rear and side view of the brassiere 20 when in place on a wearer. Note that the preferred shape of the ribs 22 in the sides and back of the brassiere 20 is such as to provide pathways from the underarm and the back toward the axillary lymph node, in keeping with the pathways shown for the flow of lymph in these areas delineated in the posterior view of FIG. 1.

Figure 8:
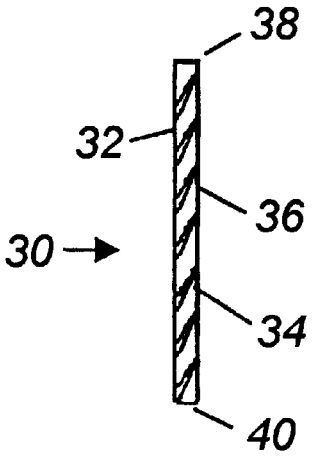
FIG. 8 depicts an alternative embodiment of the invention wherein a plurality of semi-rigid plastic nibs or fingers are integrally molded into an inner surface to provide a massaging action when the garment is worn.

In a second preferred embodiment of the invention, the conventional brassiere shape of FIG. 1 is also substantially maintained, but the material comprising the brassiere is formed of a sandwich 30 as shown in FIG. 8. An outer wall 32 of the sandwich is provided of a flexible and moldable material such as plastic which has a plurality of semi-rigid plastic nibs or fingers 34 integrally molded into an inner surface thereof. The axes of the fingers are oriented upward at an angle of between 45 and about 60 degrees from the horizontal. The sandwich further includes an inner wall 36 which is designed to lie against the wearer's skin and which is substantially parallel to the outer wall and may be fabricated of a soft textile material. The tips of the fingers rest upon the inner surface of the inner wall, as shown. The outer and inner walls are joined together at the top 38 and bottom 40 of the respective brassiere sections in a manner which allows the outer wall to translate up and down about ¼ of an inch with respect to the inner wall. The shoulder straps of the brassiere are attached to the outer wall 32 of the sandwich material, which forms the support band as well as the cup portion of the brassiere.

The operation of this embodiment is as follows. When the user is wearing the brassiere, upward arm and shoulder motion as a result of normal body movement during the day causes the shoulder straps to periodically pull up on the outer wall of the fabric, which causes the semi-rigid fingers 34 to press against and slide upward along the inner wall, hence exerting a generally upward force on the wearer's skin. This force gently massages the lymph ducts, helping to push the lymph fluid in the desired upward direction as shown in FIGS. 1 and 2. When the user's arms and shoulders are lowered, the outer wall slides down with respect to the inner wall, and because of the orientation of the fingers, very little pressure is exerted by them on the inner wall and skin surface of the wearer. Thus, from the daily movements of the wearer, there is a net upward pressure differential created against the skin, and hence lymph ducts under the skin, to assist in lymph drainage.

Figure 9:
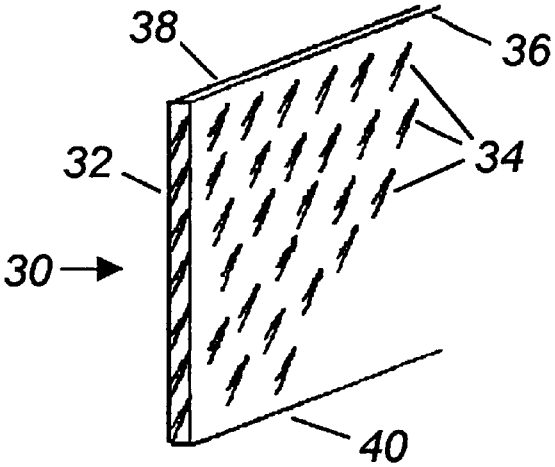
FIG. 9 is a perspective view of the embodiment of FIG. 8, showing how the orientation of the nibs or fingers may be shifted from vertical to align with the lymph ducts in a particular duct area.
Figure 3:
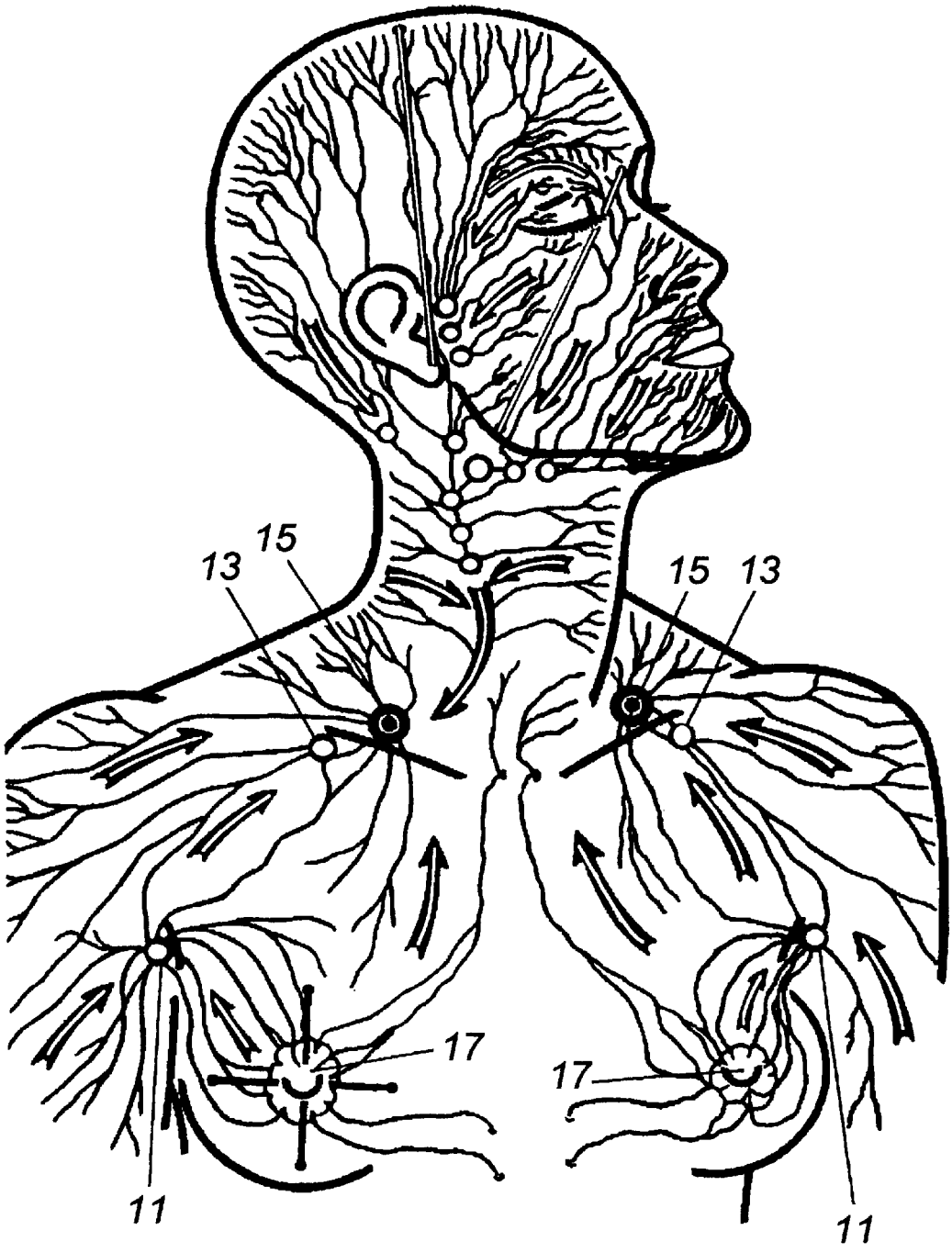
FIG. 3 is a diagram of the lymph drainage from the head, neck and breast area.

As previously described with respect to FIGS. 2 and 3, the direction of flow of lymph varies in angle at various locations around the breast and back area. Accordingly, the orientation of the fingers 34 in the sandwich material 30 is varied in the construction of the brassiere, depending upon the location of the material with respect to the lymph ducts, so that the axes of the fingers in any particular area will be as parallel as practical with the lymph ducts in that area. FIG. 9 is a perspective view of the sandwich 30 showing how the finger orientation may be shifted from vertical to align with the lymph ducts in a particular duct area.

I claim:

1. A garment that facilitates the flow of lymphatic fluid through lymph drainage pathways in the breast of a human female, the garment comprising:

a piece of flexible material having an inner surface which, when worn, covers at least a portion of a human female breast;

the material including a pattern of alternating higher and lower skin-compression areas; and wherein the pattern physically corresponds to the lymph drainage pathways.

2. The garment of claim 1, wherein the material forms part of a brassiere.

3. The garment of claim 1, wherein the alternating higher and lower skin-compression areas are in the form of elongated, relatively higher density ribs extending generally away from the nipple area of the breast.

4. The garment of claim 1, wherein the breast is divided into upper, lower, outer and medial quadrants, and wherein the pattern corresponds to lymph drainage pathways leading to an axillary node associated with the upper and lower outer quadrants.

5. The garment of claim 1, wherein the breast is divided into upper, lower, outer and medial quadrants, and wherein the pattern corresponds to lymph drainage pathways leading to an subclavicular node associated with the upper medial quadrant.

6. The garment of claim 1, wherein the breast is divided into upper, lower, outer and medial quadrants, and wherein the pattern corresponds to lymph drainage pathways leading to an intercostal space associated with the lower medial quadrant.

7. The garment of claim 1, wherein the pattern is defined by pockets or cells at least partially filled with a solid.

8. The garment of claim 1, wherein the pattern is defined by pockets or cells at least partially filled with a liquid.

9. The garment of claim 1, wherein the pattern is defined by pockets or cells at least partially filled with a gas.

10. The garment of claim 1, further including a patterned side panel.

11. The garment of claim 1, further including a patterned back panel.

12. The garment of claim 1, wherein the alternating higher and lower skin-compression areas are in the form of localized, semi-rigid regions operative to massage the lymph drainage pathways when the garment is worn.

13. The garment of claim 12, wherein the regions are in the form of semi-rigid members disposed at an angle relative to the skin and terminating in skin-contacting points, causing the application of a generally upward force when the garment is worn.

14. A garment that facilitates the flow of lymphatic fluid through lymph drainage pathways in a human female breast defined by upper, lower, outer and medial quadrants, the garment comprising:

a piece of flexible material having an inner surface which, when worn, covers at least a portion of a human female breast;

the material including a pattern of alternating skin-contacting and skin non-contacting areas; and wherein the pattern physically corresponds to the lymph drainage pathways.

15. The garment of claim 14, wherein the material forms part of a brassiere.

16. The garment of claim 14, wherein the skin-contacting and skin non-contacting areas are in the form of elongated, relatively higher density ribs extending generally away from the nipple area of the breast.

17. The garment of claim 14, wherein the pattern corresponds to lymph drainage pathways leading to an axillary node associated with the upper and lower outer quadrants.

18. The garment of claim 14, wherein the pattern corresponds to lymph drainage pathways leading to an subclavicular node associated with the upper medial quadrant.

19. The garment of claim 14, wherein the pattern corresponds to lymph drainage pathways leading to an intercostal space associated with the lower medial quadrant.

20. The garment of claim 14, wherein the pattern is defined by pockets or cells at least partially filled with a solid.

21. The garment of claim 14, wherein the pattern is defined by pockets or cells at least partially filled with a liquid.

22. The garment of claim 14, wherein the pattern is defined by pockets or cells at least partially filled with a gas.

23. The garment of claim 14, further including a patterned side panel.

24. The garment of claim 14, further including a patterned back panel.

25. The garment of claim 14, wherein the alternating skin-contacting and skin non-contacting areas are in the form of localized, semi-rigid regions operative to massage the lymph drainage pathways when the garment is worn.

26. The garment of claim 25, wherein the regions are in the form of semi-rigid members disposed at an angle relative to the skin and terminating in skin-contacting points, causing the application of a generally upward force when the garment is worn.

* * * * *